US005386791A

United States Patent [19]

Sato et al.

[11] Patent Number: 5,386,791

[45] Date of Patent: Feb. 7, 1995

[54] NEEDLE BAR THREAD GUIDE DEVICE

[75] Inventors: Shuichi Sato; Norio Komori, both of Tochigi, Japan

[73] Assignee: The Singer Company, N.V., Curacao, Netherlands Antilles

[21] Appl. No.: 175,460

[22] Filed: Dec. 30, 1993

[30] Foreign Application Priority Data

May 28, 1993 [JP] Japan ..... 5-033140

[51] Int. Cl.[6] ..... D05B 97/00; B65H 57/04

[52] U.S. Cl. ..... 112/302

[58] Field of Search ..... 112/302, 270, 254, 285, 112/222, 226, 227

[56] References Cited

U.S. PATENT DOCUMENTS

| | | | |
|---|---|---|---|
| 927,795 | 7/1909 | Haussler | 112/254 |
| 3,040,681 | 6/1962 | Kastrup | 112/302 |
| 3,584,589 | 6/1971 | Pirrello | 112/254 X |
| 4,215,641 | 8/1980 | Dobrjanskyj et al. | 112/302 X |
| 4,947,773 | 8/1990 | Blanc | 112/302 |

*Primary Examiner*—Peter Nerbun

[57] ABSTRACT

A needle bar thread guide device for a sewing machine comprises a needle bar thread guide which is fixed to the lower end portion of the needle bar of the sewing machine and has a thread retaining portion therein for guiding the needle thread and an auxiliary thread guide which is mounted on the needle bar above the needle bar thread guide in such a way as to be adjustable in its vertical position and has a threading hole therein for passing the needle thread therethrough so as to apply a frictional force to the needle thread by contacting the needle thread at the rim thereof, characterized in that the retaining point of the thread retaining portion and the contact point of the threading hole are shifted from each other in a plan view. As a result, the remaining length of the needle thread end under the needle eye after trimming can be made as short as possible and nevertheless the needle thread is effectively prevented from coming off the needle eye at the start of sewing operation, so that keeping the good appearance of the end portion of needle thread remaining in sewn products and preventing errors in sewing operation stand together.

1 Claim, 3 Drawing Sheets

NEEDLE BAR THREAD GUIDE DEVICE

BACKGROUND OF THE INVENTION

1. Field of the Invention

The present invention relates to a needle bar thread guide device for a sewing machine.

2. Description and Problems of the Related Art

A conventional sewing machine, for example, a conventional industrial lockstitch sewing machine is provided with a needle bar thread guide at the lower end portion of a needle bar. When such a sewing machine is equipped with a thread trimming device, it is desirous that a needle thread end which has been trimmed by the thread trimming device remains on the needle side to be as short as possible so long as the stitch of the next sewn product is acceptable at the starting portion thereof. When, for this reason, the thread is adjusted that the needle thread end remains short on the needle side after trimming, the needle thread is liable to come off a needle eye at the start of next sewing. Particularly in a rotary thread take-up type high-speed zigzag sewing machine, the needle thread is liable to come off the needle eye at the start of next sewing in case of some kinds of sewing material or thread so that it is no more possible to continue sewing since the needle thread is pulled up by the rotary thread take-up rapidly and in large quantities. The conventional needle bar thread guide only functions to prevent the needle thread from slackening and to guide the same to the needle eye correctly, but has substantially no function to apply a frictional resistance thereto to prevent the same from coming off the needle eye.

SUMMARY OF THE INVENTION

The present invention provides a needle bar thread guide device for a sewing machine comprising a needle bar thread guide 2 which is fixed to the lower end portion of the needle bar 1 of the sewing machine and has a thread retaining portion 3 therein for guiding the needle thread NT and an auxiliary thread guide 5 which is mounted on the needle bar 1 above the needle bar thread guide 2 in such a way as to be adjustable in its vertical position and has a threading hole 6 therein for passing the needle thread NT therethrough so as to apply a frictional force to the needle thread NT by contacting the needle thread NT at the rim thereof, characterized in that the retaining point A of the thread retaining portion 3 and the contact point B of the threading hole 6 are shifted from each other in a plan view.

The auxiliary thread guide 5 has a mounting barrel portion 5*a* which is incompletely annular in cross section and which can elastically clamp the outer periphery of the needle bar 1.

When sewing starts, the thread take-up applies an upward pulling force to the needle thread NT. The needle thread NT can sufficiently cope with the upward pulling force by way of the frictional force generated at the rims of the thread retaining portion 3 and the threading hole 6 since the needle thread NT not only passes through the thread retaining portion 3 of the needle bar thread guide 2 but also through the threading hole 6 of the auxiliary thread guide 5. That is, the retaining point A of the thread retaining portion 3 and the contact point B of the threading hole 6 are shifted from each other by a given distance in a plan view and consequently the needle thread NT is bent at the threading hole 6 and the thread retaining portion 3 as it passes therethrough, so that the needle thread NT vertically extends in zigzags. Accordingly, the needle thread NT contacts the rim of the threading hole 6 and the side edge of the thread retaining portion 3 securely to rub with the same.

As a result, the needle thread NT is effectively prevented from coming off the needle eye at the start of sewing. Accordingly, it is possible to make the remaining length of the sewing thread end, i.e., the length of the needle thread NT under the needle eye as short as possible in order to prevent a sewing error. Moreover, it is possible to adjust the frictional force applied to the needle thread NT according to the kind of the sewing material or the needle thread NT since the distance between the retaining point A of thread retaining portion 3 and the contact point B of the threading hole 6 can be varied by vertically adjusting the mounting position of the auxiliary thread guide 5 to change the zigzag state of the needle thread NT.

Since the auxiliary thread guide 5 has a mounting barrel portion 5*a* which has an incomplete annular cross section and which elastically clamps the outer periphery of the needle bar 1, the mounting position of the auxiliary thread guide 5 can be freely vertically adjusted by sliding the mounting barrel portion 5*a* along the outer periphery of the needle bar 1.

PREFERRED EMBODIMENT OF THE INVENTION

An embodiment of the present invention will be described hereinafter.

FIGS. 1 to 4 show an embodiment of the present invention. In the figures denoted at 1 is a needle bar which is vertically disposed and reciprocated as the rotational motion of the arm shaft of a sewing machine, not shown, is converted into a linear reciprocating motion by way of a needle bar connecting link. The needle bar 1 which is round in cross section is chamfered at the lower end portion thereof on the side near which the needle thread NT passes so as to form a chamfered portion 1*a*. The needle bar thread guide 2 and the auxiliary thread guide 5 are fixed to the lower end portion of the needle bar 1.

Figure 1:
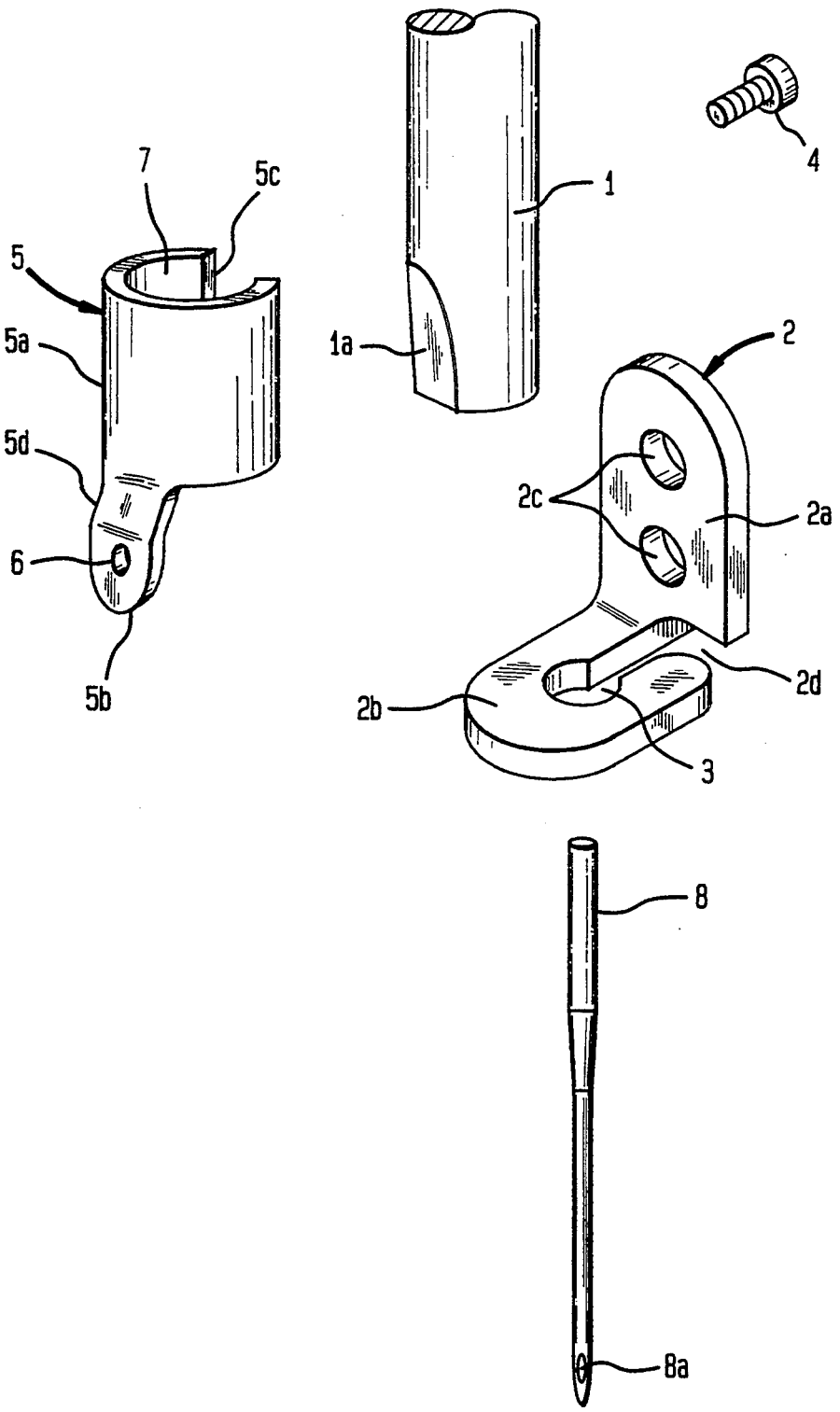
FIG. 1 is an exploded perspective view showing a needle bar thread guide device for a sewing machine according to an embodiment of the present invention.

The needle bar thread guide 2 comprises a mounting portion 2*a* having a circular-arc cross section and a thread guide portion 2*b* which is formed by bending the lower end portion of the mounting portion 2*a* substantially at right angles as illustrated in FIG. 1. A plurality of through holes 2*c* are formed in the mounting portion 2*a* and a round thread retaining portion 3 is formed in the central portion of the thread guide portion 2*b* in which an L-shaped thread introducing route 2*d* is formed to connect the thread retaining portion 3 and the base end portion of the thread guide portion 2b on the side of the mounting portion 2a. A needle 8 and the needle thread NT can be loosely inserted into the thread retaining portion 3.

Figure 2:
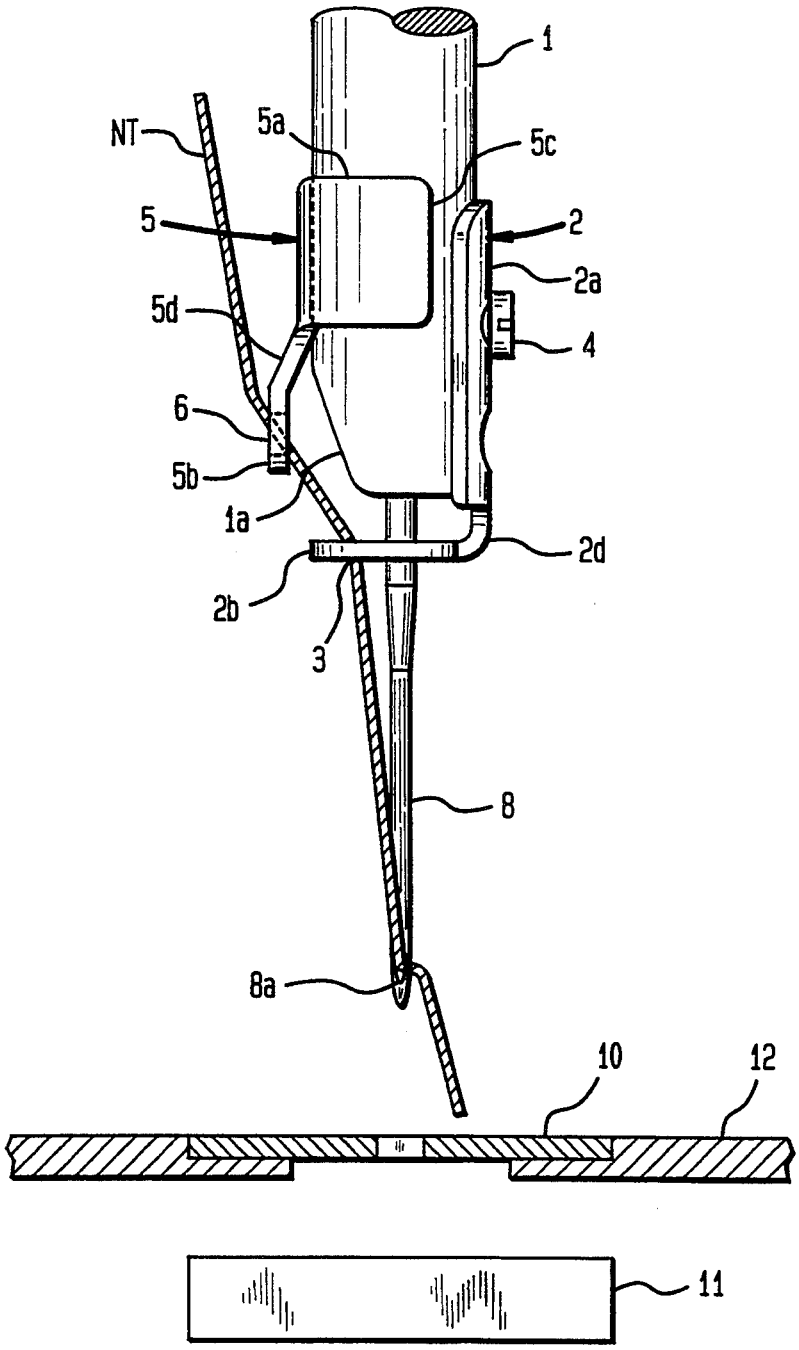
FIG. 2 is a view showing the mounting state of the needle bar thread guide device in FIG. 1.

Such a needle bar thread guide 2 is fixed to the needle bar 1 by attaching the mounting portion 2a thereof having a circular-arc cross section to the needle bar i on the side thereof opposite to that along which the needle thread NT extends, and fixing the mounting portion 2a to the needle bar 1 by a set screw 4 passed through either of the through holes 2c as illustrated in FIG. 2. The thread retaining portion 3 has functions of receiving a needle 8 and retaining the needle thread NT inserted along the thread introducing route 2d in order to prevent the needle thread NT from slackening and introduce the same to the needle eye 8a of the needle 8 correctly at the state that the needle bar thread guide 2 is attached to the needle bar 1. It is possible that the set screw 4 is available as a needle set screw for fixing the needle 8 inserted into the needle bar 1 from the lower end portion thereof to the needle bar 1.

Whereas the auxiliary thread guide 5 comprises a mounting barrel portion 5a which has an opening portion 5c to be incompletely annular in cross section and a projection 5b having a round threading hole therein and extending downward from the lower end of a connecting portion 5d which extends aslant toward the outside from the lower end portion of the mounting barrel portion 5a. The auxiliary thread guide 5 is attached to the outer periphery of the needle bar 1 by elastically clamping the same with the mounting barrel portion 5a thereof, and which can be adjusted at the vertical mounting position thereof by manually sliding the auxiliary thread guide 5 along the outer periphery of the needle bar 1. The mounting barrel portion 5a has a circumferential length corresponding to more than 180° in inscribed angle and the opening portion 5c is large enough not to interfere with the mounting portion 3a of the needle bar thread guide 2 in the state that the auxiliary thread guide 5 is attached to the needle bar 1 as illustrated in FIG. 2. Moreover, since it extends downward from the lower end of a connecting portion 5d which extends aslant toward the outside from the lower end portion of the mounting barrel portion 5a, the projection 5b forms a proper gap between the outer periphery of the needle bar 1 and itself together with the chamfered portion la of the needle bar 1, so as to prevent the interference between the needle thread NT and the needle bar 1 at the state that the needle thread NT is passed through the needle bar thread guide device, as described later.

Figure 4:
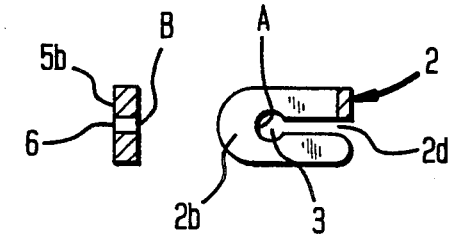
FIG. 4 is a plan view showing the positional relationship between the retaining portion of thread retaining portion and the contact portion of the threading hole in FIG. 1.

The thread retaining portion 3 of the needle bar thread guide 2 has a substantially vertical hole therein and the auxiliary thread guide 5 has a threading hole 6 which is inclined relative to the extending direction (vertical direction) of the needle thread NT, i.e., extends substantially in the horizontal direction, so that the center line of the thread retaining portion 3 intersects with that of the threading hole 6 in the air. The needle thread NT vertically extending from a spool, not shown, along the side surface of the needle bar 1 by way of the rotary thread take-up, thread guide etc. is passed through the threading hole 6 of the auxiliary thread guide 5 from the outer side thereof, and then is introduced into the needle bar thread guide 2 along the thread introducing route 2d until it is retained by the thread retaining portion 3, and thereafter is passed through the needle eye 8a of the needle 8. Accordingly, the needle thread NT which extends vertically contacts the threading hole 6 at the upper or lower rim thereof and is retained by the side edge of the thread retaining portion 3 of the auxiliary thread guide 5, wherein the retaining point A of the thread retaining portion 3 and the contact point B of the threading hole 6 are shifted by a given distance from each other in a plan view as illustrated in FIG. 4.

Furthermore, a thread trimming device 11 is provided under a throat plate 10 arranged in a sewing machine bed 12 as illustrated in FIG. 2. The thread trimming device 11 having a well known construction has a function to trim the sewing threads composed of the needle thread NT and a bobbin thread by crossing a pair of cutting knives after completion of a series of sewing operations.

The operation of the needle bar thread guide device will be described hereinafter.

In the needle bar thread guide device having a construction set forth above, the needle thread NT and the bobbin thread are trimmed by the thread trimming device 11 after completion of a series of sewing operations. Successively a sewing operation starts for next sewing material and an upward pulling force is applied to the needle thread NT due to the operation of the rotary thread take-up. Since the needle thread NT passes not only through the thread retaining portion 3 of the needle bar thread guide 2 but also through the threading hole 6 of the auxiliary thread guide 5, it can sufficiently cope with the upward pulling force owing to the frictional force generated at the portions thereof which contact the rims of the thread retaining portion 3 and the threading hole 6. That is, since the threading hole 6 of the auxiliary thread guide 5 has openings directed almost horizontally, the vertically extending needle thread NT can rub against the upper or lower edge the threading hole 6 at the contact point B thereof and against the side edge of the thread retaining portion 3 of the needle bar thread guide 2 at the retaining point A thereof. Moreover, since the retaining point A of the thread retaining portion 3 and the contact point B of the threading hole 6 are shifted from each other by a given distance in a plan view, the needle thread NT passes through the threading hole 6 and the thread retaining portion 3 in zigzags. Accordingly, the needle thread NT contacts the contact point B of the threading hole 6 and the retaining point A of the thread retaining portion 3 of the needle bar thread guide 2 with certainty, so as to generate a comparatively large frictional force against the rapid movement of the needle thread NT.

Thereby effectively prevented is the needle thread NT from coming off the needle eye 8a of the needle 8 at the start of sewing operation. As a result, it is possible to prevent errors in sewing operation due to the thread coming-off and nevertheless make the remaining length of sewing threads, particularly that of the needle thread NT as short as possible when the same is trimmed by the thread trimming device 11.

Figure 3:
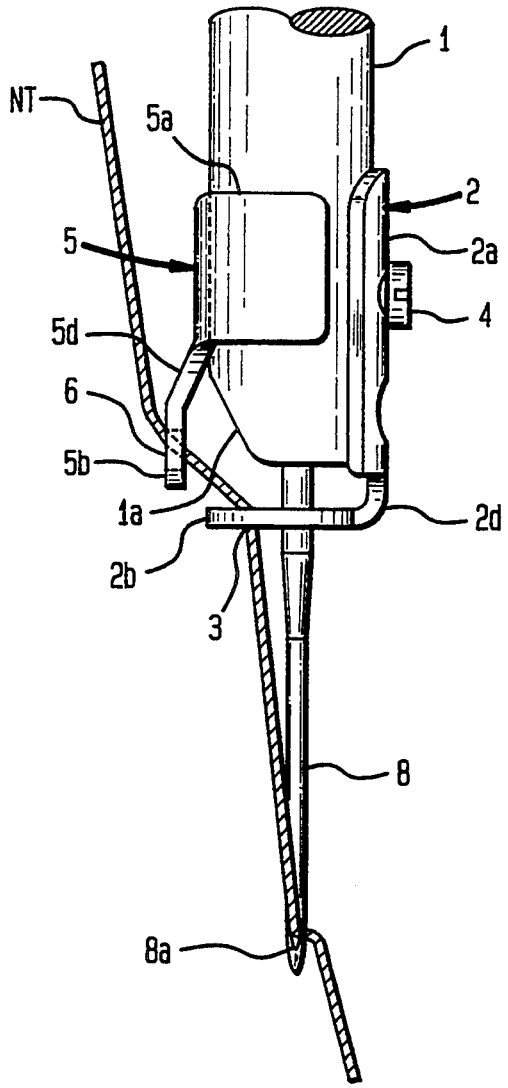
FIG. 3 is a view for explaining the operation of the needle bar thread guide device of FIG. 1.

FIG. 3 shows the auxiliary thread guide 5 which is displaced in mounting position on the needle bar 1. When the auxiliary thread guide 5 is slid downward along the needle bar 1 by manually lowering the mounting barrel portion 5a so as to change the mounting position of the auxiliary thread guide 5 on the needle bar 1, the threading hole 6 of the auxiliary thread guide 5 is brought near to the thread retaining portion 3 of the needle bar thread guide 2. As a result, the friction between the needle thread NT and the lower edge of the threading hole 6 is reduced but the needle thread NT is more bent and consequently the friction with the upper edge of the threading hole 6 and the side edge of the thread retaining portion 3 of the needle bar thread guide 2 is increased, so that the frictional force applied to the needle thread NT is increased as a whole. Consequently the passing resistance of the needle thread NT is increased so that the needle thread NT hardly comes off the needle eye 8*a*. In this way it is possible to adjust the frictional force applied to the needle thread NT by changing the vertical mounting position of the auxiliary thread guide 5 on the needle bar 1. Accordingly, it is possible to apply a proper frictional force to the needle thread NT to prevent the same from coming off the needle eye 8*a* according to the kind of the sewing material or the needle thread NT while restraining the resistance against the regular supply of the needle thread NT as much as possible.

Although the threading hole 6 of the auxiliary thread guide 5 is round and the needle thread NT is passed through the threading hole 6 from the outer side thereof according to the embodiment set forth above, it is also possible to form a thread introducing route connected radially to the threading hole 6 and insert the needle thread NT thereinto by way of the thread introducing route.

As understood from the above description, since the remaining length of the needle thread end under the needle eye can be made as short as possible and nevertheless the needle thread is effectively prevented from coming off the needle eye at the start of sewing operation, keeping the good appearance of the end portion of needle thread remaining in sewn products and preventing errors in sewing operation stand together by means of the simple-structured needle bar thread guide device for a sewing machine according to the present invention.

What is claimed is:

1. In combination with a sewing machine having a vertical needle bar, the bar having a lower-end portion chamfered on the side near the passage of the needle thread, and a vertical needle secured to the lower end of the bar and extending therebelow, the needle having a thread receiving opening in its lower end, a needle bar thread guide device comprising:

a needle bar thread main guide having an upper vertical mounting section detachably secured to the bar in a vertically adjustable position opposite the chamfered portion; an integral lower end thread guide section extending at right angles to the upper section, and an integral central section interconnecting the upper and lower sections, the central section having an L shaped thread introducing route, the lower section having a first thread receiving opening communicating with the thread introducing route and having an opening through which said needle extends; and an auxiliary thread guide having an upper vertical mounting section slidably engaging the bar in a position above the chamfered portion but oppositely disposed with respect to the upper vertical mounting section of the main guide and securable in the desired slidable position on the bar, the auxiliary guide having an integral lower section which extends inclinedly downward and outward from the lower end of the upper section of the auxiliary guide and then extends vertically downward, the vertically downward extension having a second thread receiving opening, whereby the thread can extend downwardly to the second thread receiving opening, then inclinedly downward through the thread introducing route and the first thread receiving opening along side of the needle to extend through the opening in the lower end of the needle.

* * * * *